US010996586B2

(12) United States Patent
Nagamoto et al.

(10) Patent No.: US 10,996,586 B2
(45) Date of Patent: May 4, 2021

(54) IMAGE FORMING APPARATUS

(71) Applicant: KYOCERA Document Solutions Inc., Osaka (JP)

(72) Inventors: Takeru Nagamoto, Osaka (JP); Ryo Taniguchi, Osaka (JP); Atsuya Ikeuchi, Osaka (JP)

(73) Assignee: KYOCERA Document Solutions Inc., Osaka (JP)

( * ) Notice: Subject to any disclaimer, the term of this patent is extended or adjusted under 35 U.S.C. 154(b) by 0 days.

(21) Appl. No.: 16/928,894

(22) Filed: Jul. 14, 2020

(65) Prior Publication Data

US 2021/0018856 A1 Jan. 21, 2021

(30) Foreign Application Priority Data

Jul. 18, 2019 (JP) ..... JP2019-132963

(51) Int. Cl.
*G03G 15/08* (2006.01)
*G03G 15/00* (2006.01)

(52) U.S. Cl.
CPC ..... *G03G 15/0851* (2013.01); *G03G 15/5041* (2013.01)

(58) Field of Classification Search
CPC ..... G03G 15/0851; G03G 15/0849; G03G 15/5041; G03G 15/065
See application file for complete search history.

(56) References Cited

U.S. PATENT DOCUMENTS

2006/0239701 A1 10/2006 Ishibashi ..... 399/30
2016/0291507 A1* 10/2016 Nakayama ..... G03G 15/0849

FOREIGN PATENT DOCUMENTS

JP 2009-169057 A 7/2009

OTHER PUBLICATIONS

Extended European Search Report from the European Patent Office dated Nov. 30, 2020 for corresponding European Application No. 20185694.5.

* cited by examiner

*Primary Examiner* — Sandra Brase
(74) *Attorney, Agent, or Firm* — Stein IP, LLC

(57) ABSTRACT

An image forming apparatus includes: an image forming portion having an image carrying member, a charging device, an exposing device, and a developing device; a developing voltage power supply; a control portion; and an image density sensor. The developing device has a developer carrying member that carries two-component developer and a toner concentration sensor. The control portion senses toner concentration during calibration or during first image formation after calibration for correcting image density based on the sensing result from the image density sensor. If the difference Vtarget−V between the output value V of the toner concentration sensor actually sensed and a target value Vtarget of the toner concentration sensor to be observed when the toner concentration equals a reference concentration is equal to or larger than a predetermined value, the control portion performs calibration again when the amount of toner consumed after calibration reaches a predetermined threshold value.

9 Claims, 4 Drawing Sheets

IMAGE FORMING APPARATUS

INCORPORATION BY REFERENCE

This application is based on and claims the benefit of Japanese Patent Application No. 2019-132963 filed on Jul. 18, 2019, the contents of which are hereby incorporated by reference.

BACKGROUND

The present disclosure relates to an image forming apparatus, such as a copier, a facsimile machine, or a printer, provided with a developing device that uses two-component developer containing magnetic carrier and toner. More particularly, the present disclosure relates to a method of predicting variation of the toner concentration in developer in a developing device.

Conventionally, as developing methods that use dry toner in image forming apparatuses employing an electrophotographic process, there are known a one-component developing method that uses no carrier and a two-component developing method that uses two-component developer, that is, developer in which non-magnetic toner is electrostatically charged using magnetic carrier, and that develops an electrostatic latent image on an image carrying member (photosensitive member) with a magnetic brush formed of magnetic carrier and toner that is formed on a developing roller.

In a developing device employing a two-component developing method, the toner concentration (the ratio of toner to carrier in developer) in the developing device is sensed by a toner concentration sensor, and as much toner as consumed by printing and the like is newly fed in. However, if the output of the toner concentration sensor varies due to a factor, such as temperature, other than variation of the toner concentration, toner concentration cannot be grasped accurately, with the result that, by unintended toner feeding, the actual value of the toner concentration may be higher than the intended toner concentration (reference concentration).

In that case, during disuse after the end of printing or the like, the temperature inside the developing device lowers and the output of the toner concentration sensor returns to normal; thus, printing may be performed with no new toner being fed in until the actual value of the toner concentration becomes equal to the reference concentration. Consequently, the amount of charge with which the toner inside the developing device is charged rises, and the developing performance of the toner falls; this may lead to a sharp drop in image density in subsequent printing. One measure is to correct the sensor output value in accordance with temperature, which is the factor causing variation of the sensor output, and this alleviates the increase or decrease in the toner concentration. However, increasing the accuracy of the sensing of the toner concentration requires a plurality of temperature sensors, and this leads to increased costs.

As one method of alleviating a drop in image density resulting from variation of toner concentration, there is known, for example, an image forming apparatus comprising a toner image forming means for forming a toner image on an intermediary transfer belt; a test image forming means for forming a test image between two toner images on the intermediary transfer belt; a density sensing means for sensing the density of the test image; a difference calculating means for calculating the difference between a predetermined ideal value and the sensed density; and an increasing-decreasing means for increasing and decreasing the developing voltage in accordance with the difference, the image forming apparatus thus being able to correct density promptly in response to a change in developing characteristics.

SUMMARY

According to one aspect of the present disclosure, an image forming apparatus includes an image forming portion, a developing voltage power supply, a control portion, and an image density sensor. The image forming portion includes: an image carrying member which has a photosensitive layer formed on its surface; a charging device which electrostatically charges the surface of the image carrying member, an exposing device which exposes the surface of the image carrying member electrostatically charged by the charging device to light to form an electrostatic latent image; and a developing device. The developing device has: a developer container which stores two-component developer containing carrier and toner, a developer carrying member which is rotatably supported inside the developer container and which carries the two-component developer on its surface; and a toner concentration sensor which senses the toner concentration in the two-component developer inside the developer container. The developing device develops the electrostatic latent image into a toner image by use of the developer carrying member. The developing voltage power supply applies a developing voltage to the developer carrying member. The image density sensor senses the image density of the toner image formed by the image forming portion. The control portion controls the image forming portion and the developing voltage power supply. The control portion can perform calibration for correcting the image density by adjusting the developing voltage based on the sensing result from the image density sensor. The control portion senses the toner concentration with the toner concentration sensor during calibration or during first image formation after calibration and, if the difference Vtarget−V between the output value V of the toner concentration sensor that is actually sensed and the target value Vtarget of the toner concentration sensor that should be observed when the toner concentration equals a reference concentration is equal to or larger than a predetermined value, the control portion performs the calibration again when the amount of toner consumed reaches a predetermined threshold value after calibration.

This and other objects of the present disclosure, and the specific benefits obtained according to the present disclosure, will become apparent from the description of embodiments which follows.

DETAILED DESCRIPTION

Figure 1:
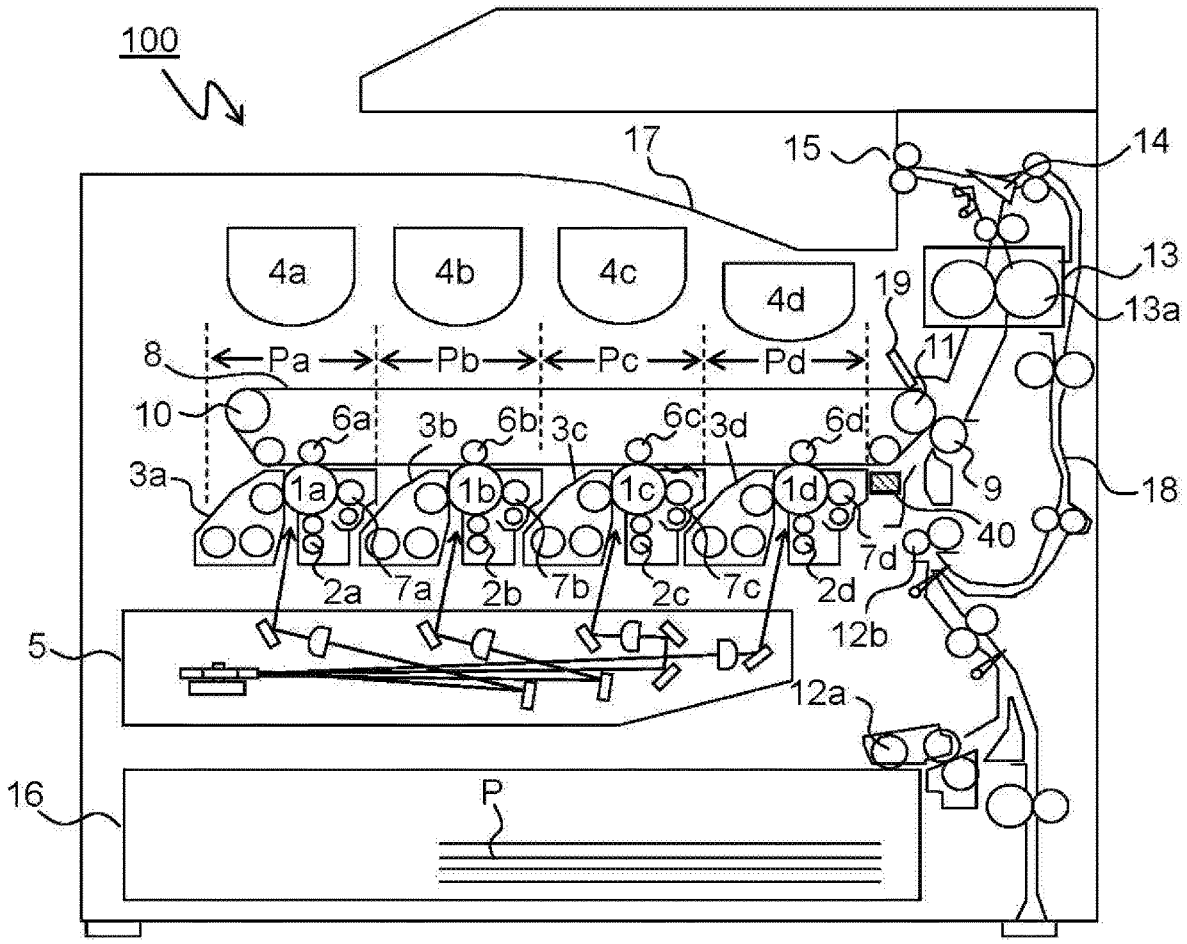
FIG. 1 is a schematic diagram showing an overall construction of an image forming apparatus according to one embodiment of the present disclosure.

An embodiment of the present disclosure will be described below with reference to the accompanying drawings. FIG. 1 is a sectional view showing the internal construction of an image forming apparatus 100 according to one embodiment of the present disclosure. In the body of the image forming apparatus 100 (here, a color printer), four image forming portions Pa, Pb, Pc, and Pd are arranged in this order from upstream (in FIG. 1, the left side) in the conveying direction. These image forming portions Pa to Pd are provided to correspond to four different colors (cyan, magenta, yellow, and black), and respectively form a cyan, a magenta, a yellow, and a black image sequentially through the processes of charging, exposure, developing, and transfer.

In the image forming portions Pa to Pd, photosensitive drums (image carrying members) 1*a*, 1*b*, 1*c*, and 1*d* that carry visible images (toner images) of different colors are arranged. Also an intermediary transfer belt (intermediary transferring member) 8 that is driven by a driving motor (not shown) to rotate counter-clockwise in FIG. 1 is provided next to the image forming portions Pa to Pd. The toner images formed on the photosensitive drums 1*a* to 1*d* are, by being primarily transferred sequentially to the intermediary transfer belt 8, which moves while in contact with the photosensitive drums 1*a* to 1*d*, overlaid on each other. Thereafter, the toner images primarily transferred to the intermediary transfer belt 8 are secondarily transferred by a secondary transfer roller 9 to a transfer sheet P as one example of a recording medium. The transfer sheet P having the toner images secondarily transferred to it then has the toner images fixed to it in a fixing portion 13, and is then discharged out of the body of the image forming apparatus 100. While the photosensitive drums 1*a* to 1*d* are rotated clockwise in FIG. 1, an image forming process is performed with respect to the photosensitive drums 1*a* to 1*d*.

Transfer sheets P to which toner images will eventually be secondarily transferred are stored inside a sheet cassette 16 arranged in a lower part of the body of the image forming apparatus 100. A transfer sheet P is conveyed via a sheet feed roller 12*a* and a pair of registration rollers 12*b* to the nip between the secondary transfer roller 9 and a driving roller 11 for the intermediary transfer belt 8. Used as the intermediary transfer belt 8 is a sheet of a dielectric resin, typically a belt with no seam (a seamless belt). Downstream of the secondary transfer roller 9, a blade-form belt cleaner 19 for removing toner and the like left on the surface of the intermediary transfer belt 8 is provided.

Next, the image forming portions Pa to Pd will be described. Around and under the photosensitive drums 1*a* to 1*d*, which are arranged rotatably, there are provided charging device 2*a*, 2*b*, 2*c*, and 2*d* which electrostatically charge the photosensitive drums 1*a* to 1*d*, an exposure device 5 which exposes the photosensitive drums 1*a* to 1*d* to light conveying image information, developing device 3*a*, 3*b*, 3*c*, and 3*d* which form toner images on the photosensitive drums 1*a* to 1*d*, and cleaning devices 7*a*, 7*b*, 7*c*, and 7*d* which remove developer (toner) and the like left on the photosensitive drums 1*a* to 1*d*.

When image data is fed in from a host device such as a personal computer, first, the charging devices 2*a* to 2*d* electrostatically charge the surfaces of the photosensitive drums 1*a* to 1*d* uniformly. Next, the exposure device 5 radiates light based on the image data so that electrostatic latent images based on the image data are formed on the photosensitive drums 1*a* to 1*d*. The developing devices 3*a* to 3*d* are loaded with predetermined amounts of two-component developer containing cyan, magenta, yellow, and black toner respectively. When, as toner images are formed as will be described later, the proportion of toner in the two-component developer in the developing devices 3*a* to 3*d* falls below a prescribed value, toner is newly fed from toner containers 4*a* to 4*d* to the developing devices 3*a* to 3*d*. The toner in the developer is supplied by the developing devices 3*a* to 3*d* onto, so as to electrostatically attach to, the photosensitive drums 1*a* to 1*d*. In this way, toner images that correspond to the electrostatic latent images formed by exposure to light from the exposure device 5 are formed on the photosensitive drums 1*a* to 1*d*.

Primary transfer rollers 6*a* to 6*d* produce an electric field with a predetermined transfer voltage between the primary transfer rollers 6*a* to 6*d* and the photosensitive drums 1*a* to 1*d* so that the cyan, magenta, yellow, and black toner images on the photosensitive drums 1*a* to 1*d* are primarily transferred to the intermediary transfer belt 8. These images of four colors are formed in a prescribed predetermined positional relationship with each other so as to form a predetermined full-color image. Thereafter, in preparation for the subsequent formation of new electrostatic latent images, the toner and the like that are left on the surfaces of the photosensitive drums 1*a* to 1*d* after primary transfer are removed by the cleaning devices 7*a* to 7*d*.

The intermediary transfer belt 8 is stretched around a driven roller 10, located upstream, and a driving roller 11, located downstream. When, as the driving roller 11 rotates by being driven by a driving motor (not shown), the intermediary transfer belt 8 starts to move around counter-clockwise, a transfer sheet P is conveyed, with predetermined timing, from the pair of registration rollers 12*b* to the nip (secondary transfer nip) between the driving roller 11 and the secondary transfer roller 9, the latter being provided next to the former. As the transfer sheet P passes through the secondary transfer nip, the full-color image on the intermediary transfer belt 8 is secondarily transferred to the transfer sheet P. The transfer sheet P having the toner images secondarily transferred to it is conveyed to the fixing portion 13.

The transfer sheet P conveyed to the fixing portion 13 is heated and pressed by a pair of fixing rollers 13*a* so that the toner images are fixed to the surface of the transfer sheet P, thereby forming the predetermined full-color image. The transfer sheet P having the full-color image formed on it has its conveying direction switched by a branch portion 14 branching into a plurality of directions so as to be discharged as it is (or after being fed into a duplex passage 18 and subjected to duplex printing) onto a discharge tray 17 by a pair of discharge rollers 15.

Downstream of the image forming portion Pd, at a place facing the intermediary transfer belt 8, an image density sensor 40 is arranged. Used as the image density sensor 40 is typically an optical sensor including a light-emitting element such as an LED and a light-receiving element such as a photodiode. During the measurement of the amount of toner attached to the intermediary transfer belt 8, when measurement light is shone from the light-emitting element to reference images formed on the intermediary transfer belt 8, the measurement light strikes, as light reflected from the toner and the belt surface, the light-receiving element.

The reflection light from the toner and the belt surface contains regularly reflected light and irregularly reflected light. The regularly and irregularly reflected light are separated by a polarizing splitter prism, and are then incident on separate light-receiving elements respectively. The light-receiving elements perform photoelectric conversion on the received regularly and irregularly reflected light and feed output signals to a main control portion 80 (see FIG. 3). Based on changes in the characteristics of the output signals with respect to regularly and irregularly reflected light, the amount of toner is monitored, and this is compared with a prescribed reference density to adjust the characteristic value of the developing voltage and the like, thereby achieving density correction (calibration) for each color.

Figure 2:
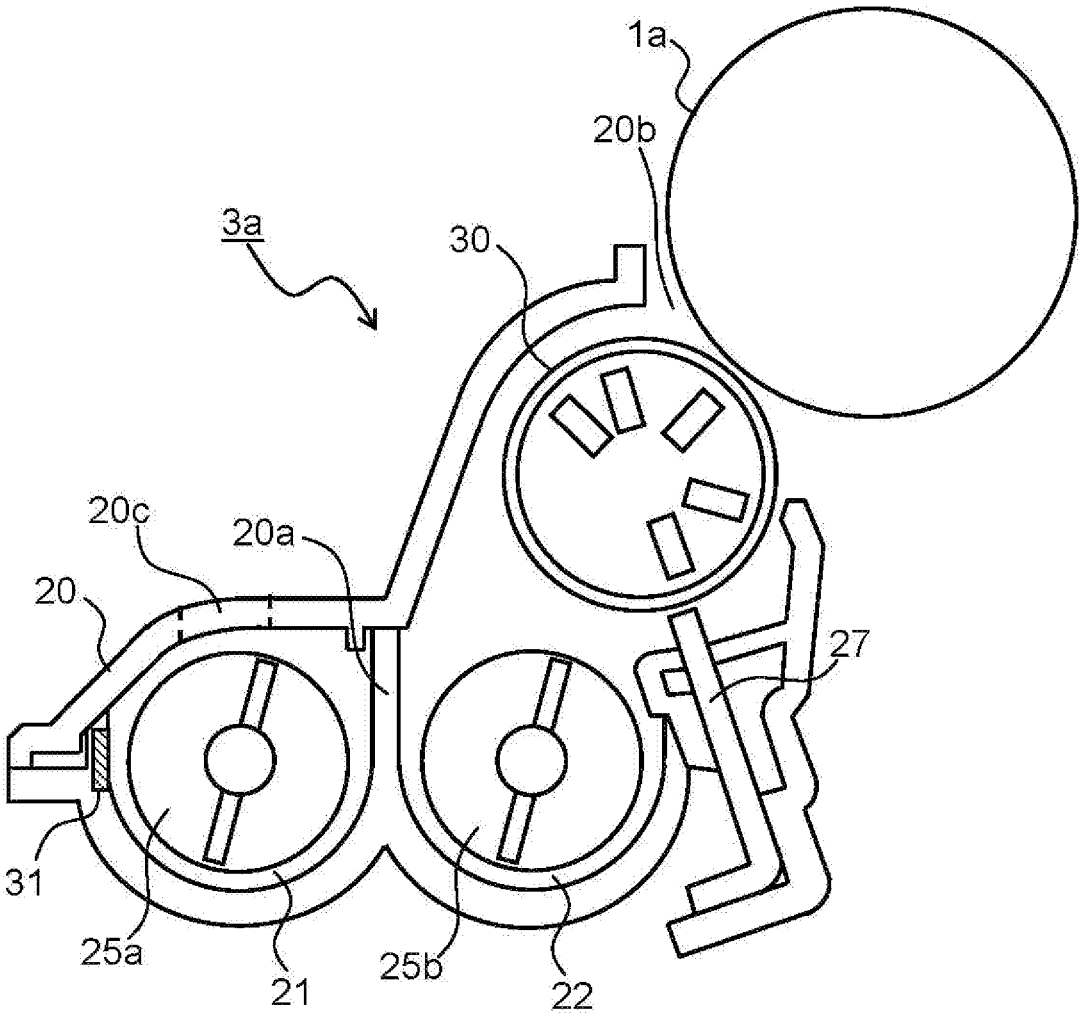
FIG. 2 is a side sectional view of a developing device incorporated in the image forming apparatus according to the embodiment.

FIG. 2 is a side sectional view of the developing device 3*a* incorporated in the image forming apparatus 100 according to the embodiment. While the following description deals with, as an example, the developing device 3*a* arranged in the image forming portion Pa in FIG. 1, the developing devices 3*b* to 3*d* arranged in the image forming portions Pb to Pd have basically the same structure, and therefore no overlapping description will be repeated.

As shown in FIG. 2, the developing device 3*a* has a developer container 20 in which two-component developer (hereinafter referred to also simply as developer) containing magnetic carrier and toner is stored. The developer container 20 is divided into a stirring-conveying chamber 21 and a feeding-conveying chamber 22 by a partition wall 20*a*. In the stirring-conveying chamber 21 and the feeding-conveying chamber 22 respectively, there are rotatably arranged a stirring-conveying screw 25*a* and a feeding-conveying screw 25*b* for mixing together, stirring, and electrostatically charging the toner fed from the toner container 4*a* (see FIG. 1).

The developer is conveyed, while being stirred, by the stirring-conveying screw 25*a* and the feeding-conveying screw 25*b* in the axial direction (in the direction perpendicular to the plane of FIG. 2), and circulates between the stirring-conveying chamber 21 and the feeding-conveying chamber 22 through unillustrated developer passages formed in opposite end parts of the partition wall 20*a*. That is, the stirring-conveying chamber 21, the feeding-conveying chamber 22, and the developer passages form a circulation passage for developer inside the developer container 20.

The developer container 20 extends diagonally up rightward in FIG. 2, and inside the developer container 20, a developing roller 30 is arranged diagonally to the upper right of the feeding-conveying screw 25*b*. Part of the outer circumferential face of the developing roller 30 is exposed through an opening 20*b* in the developer container 20 to face the photosensitive drum 1*a*. The developing roller 30 rotates counter-clockwise in FIG. 2.

The developing roller 30 is composed of a developing sleeve, which is cylindrical and which rotates counter-clockwise in FIG. 2, and a magnet with a plurality of magnetic poles, which is fixed inside the developing sleeve. Here, a developing sleeve having its surface knurled is used; it is also possible to use, instead, one having a large number of depressions (dimples) formed on its surface, or a developing sleeve having its surface blasted, or one having its surface not only knurled or dimpled but also blasted, or one having its surface plated.

In the developer container 20, a regulating blade 27 is fitted along the lengthwise direction (the direction perpendicular to the plane of FIG. 2) of the developing roller 30. Between a tip end part of the regulating blade 27 and the surface of the developing roller 30, there is formed a small interval (gap).

Figure 3:
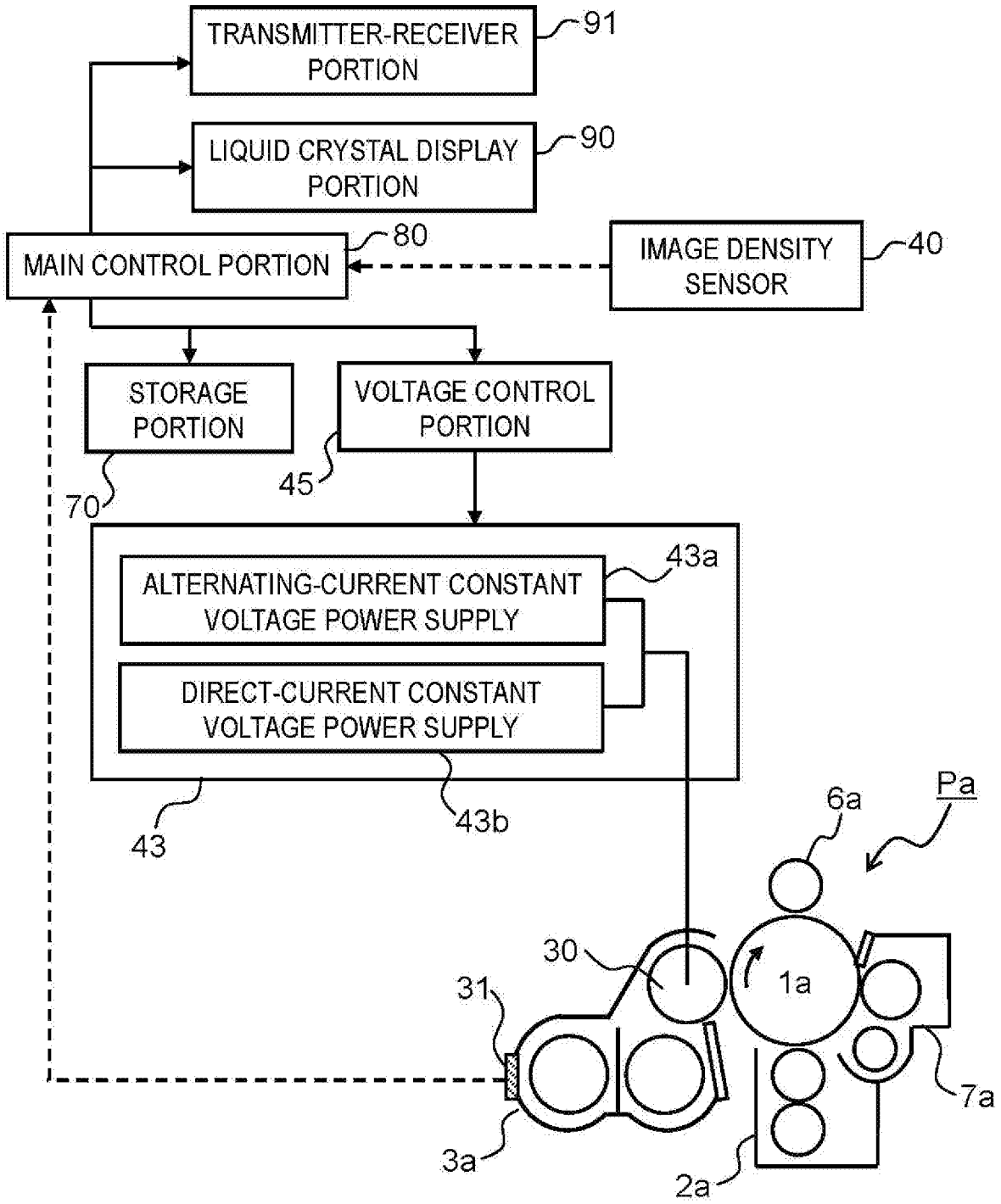
FIG. 3 is an enlarged part view around an image forming portion, including control paths of the image forming portion.

The developing roller 30 is fed with a developing voltage composed of a direct-current voltage Vslv(DC) and an alternating-current voltage Vslv(AC) from a high-voltage generation circuit 43 (see FIG. 3).

In the stirring-conveying chamber 21, opposite the stirring-conveying screw 25*a*, a toner concentration sensor 31 is arranged. The toner concentration sensor 31 senses the proportion (T/C) of toner to carrier in the developer, and used as the toner concentration sensor 31 is, for example, a magnetic permeability sensor that senses the magnetic permeability of the developer inside the developer container 20. When the toner concentration sensor 31 senses the magnetic permeability of the developer, a voltage value corresponding to the detection result is fed to the main control portion 80 (see FIG. 3), which will be described later and, based on the output value of the toner concentration sensor 31, the main control portion 80 determines the toner concentration.

The sensor output value varies with the toner concentration; the higher the toner concentration, the higher the proportion of toner to carrier, that is, the higher the proportion of toner, which is impermeable to magnetism, resulting in a low output value. On the other hand, the lower the toner concentration, the lower the proportion of toner to carrier, that is, the higher the proportion of carrier, which is permeable to magnetism, resulting in a high output value. In accordance with the determined toner concentration, the main control portion 80 feeds a control signal to a toner feeding motor (not shown), and a predetermined amount of toner is newly fed from the toner container 4*a* (see FIG. 1) via a toner supply port 20*c* to the stirring-conveying chamber 21.

FIG. 3 is an enlarged part view around the image forming portion Pa, including the control paths of the image forming portion Pa. While the following description deals with the configuration of the image forming portion Pa and its control paths, the image forming portions Pb to Pd have a similar configuration and similar control paths, and therefore no overlapping description will be repeated.

The developing roller 30 is connected to a high-voltage generation circuit 43 which generates an oscillating voltage having a direct-current voltage and an alternating-current voltage superimposed on each other. The high-voltage generation circuit 43 includes an alternating-current constant voltage power supply 43*a* and a direct-current constant voltage power supply 43*b*. The alternating-current constant voltage power supply 43*a* outputs a sine-wave alternating-current voltage generated from a low-voltage direct-current voltage modulated into pulses by use of a step-up transformer (not shown). The direct-current constant voltage power supply 43*b* outputs a direct-current voltage resulting from rectifying a sine-wave alternating-current voltage generated from a low-voltage direct-current voltage modulated into pulses by use of a step-up transformer.

During image formation, the high-voltage generation circuit 43 outputs, from the alternating-current constant voltage power supply 43*a* and the direct-current constant voltage power supply 43*b*, a developing voltage that has an alternating-current voltage superimposed on a direct-current voltage.

Next, the control system of the image forming apparatus 100 will be described with reference to FIG. 3. The image forming apparatus 100 includes a main control portion 80 including a CPU etc. The main control portion 80 is connected to a storage portion 70 including a ROM, a RAM, etc. Based on the control programs and control data stored in the storage portion 70, the main control portion 80 controls different parts of the image forming apparatus 100 (the charging devices 2*a* to 2*d*, the exposure device 5, the developing devices 3*a* to 3*d*, the primary transfer rollers 6*a* to 6*d*, the cleaning devices 7*a* to 7*d*, the fixing portion 13, the high-voltage generation circuit 43, a voltage control portion 45, etc.).

The voltage control portion 45 controls the high-voltage generation circuit 43. The voltage control portion 45 can be implemented as a control program stored in the storage portion 70.

To the main control portion 80 are connected a liquid crystal display portion 90 and a transmitter-receiver portion 91. The liquid crystal display portion 90, on one hand, functions as a touch panel which permits the user to make various settings on the image forming apparatus 100 and, on the other hand, displays the state of the image forming apparatus 100, the status of image formation, the number of copies printed, etc. The transmitter-receiver portion 91 communicates with the outside via a telephone line or an Internet line.

Depending on the use environment of the image forming apparatus 100, the output value of the toner concentration sensor 31 may vary, resulting in a large deviation of the toner concentration in the developer in the developing devices 3*a* to 3*d* from a reference concentration. Specifically, in a case where a magnetic permeability sensor is used as the toner concentration sensor 31, as the sensor temperature rises, the sensitivity falls. That is, supplying toner does not result in a fall in the output value; thus, toner is supplied excessively, resulting in a higher toner concentration in the developing devices 3*a* to 3*d* than the reference concentration.

When the image forming apparatus 100 is left unused for a long time and the sensor temperature falls until the output value returns to normal, printing is performed with no toner supplied until the toner concentration in the developing devices 3*a* to 3*d* falls to the reference concentration. As a result, the amount of charge with which the toner inside the developing devices 3*a* to 3*d* is charged rises, and the developing performance of the toner falls. If printing ins performed in this state, the image density may fall sharply during the printing of several sheets immediately thereafter. If calibration is performed, it is performed with the toner concentration inside the developing devices 3*a* to 3*d* higher than the reference concentration. Thus, as the toner concentration falls, density correction by calibration may deviate from the adequate value.

To cope with that, according to the present disclosure, when calibration is performed, the toner concentration sensor 31 senses the toner concentration inside the developing devices 3*a* to 3*d*. When the sensed value (actual value) of the toner concentration is greatly deviated from the sensed value (target value) as it should be when the toner concentration equals the reference concentration, calibration is performed again when the amount of toner corresponding to the difference between the actual value and the target value is consumed.

Figure 4:
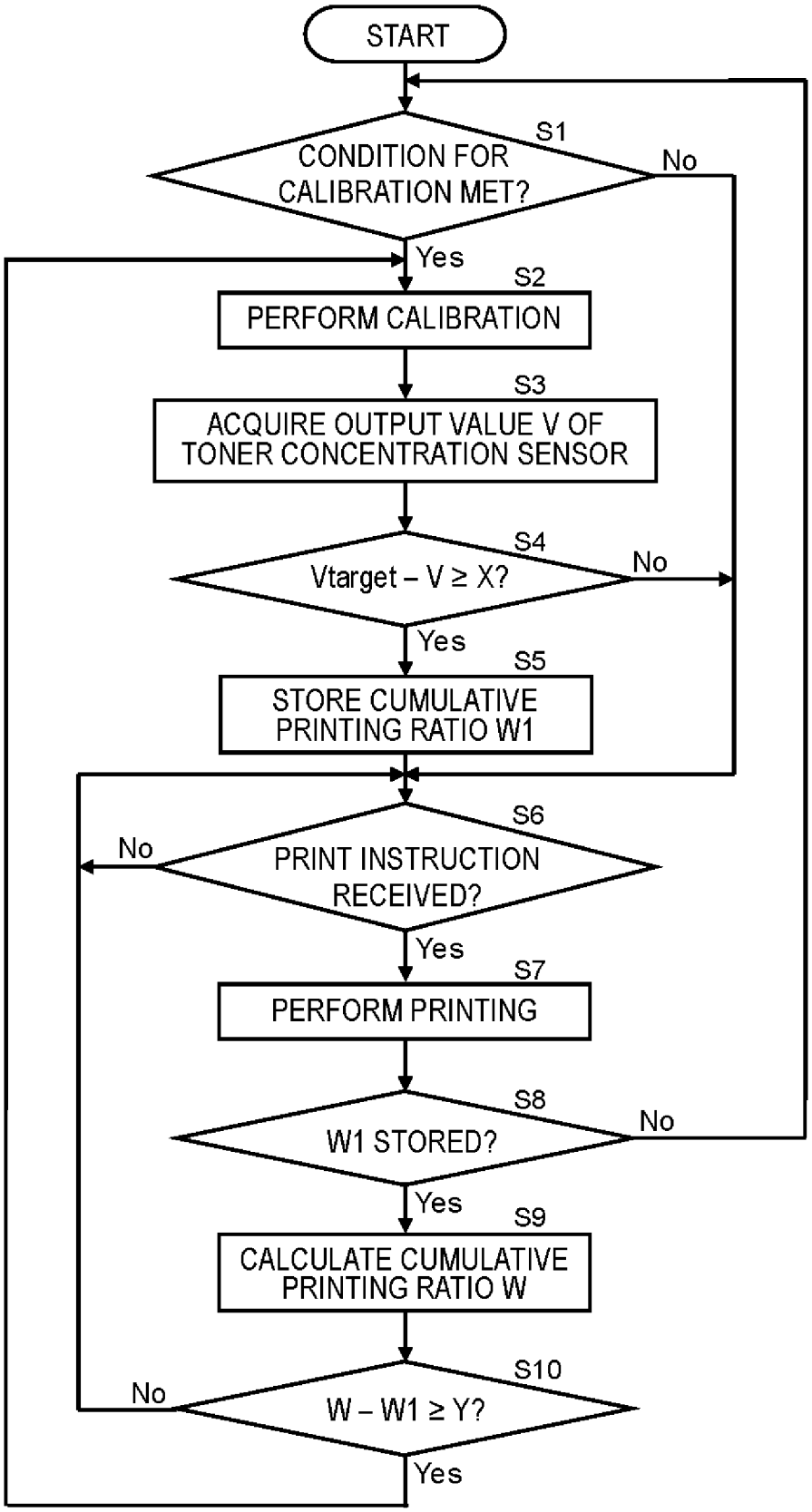
FIG. 4 is a flow chart showing an example of control for calibration on the image forming apparatus according to the embodiment.

FIG. 4 is a flow chart showing an example of the control for calibration on the image forming apparatus 100 according to the embodiment. With reference to FIGS. 1 to 3 as necessary, the procedure for performing calibration will be described along the steps in FIG. 4.

First, the main control portion 80 checks whether or not a condition for performing calibration is met (step S1). A condition for performing calibration can be, to name a few, when the power to the image forming apparatus 100 is turned on, when a return is made from a power-saving (sleep) mode, or when the cumulative number of sheets printed after the previous calibration has reached a predetermined number.

When a condition for performing calibration is met ("Yes" at step S1), calibration is performed (step S2). Specifically, for each of the colors, namely magenta, cyan, yellow, and black, a plurality of patch images (density correction patterns) with different densities are formed. Then the density of the patch images transferred to the intermediary transfer belt 8 is sensed by the image density sensor 40, and based on the sensing results, the developing voltage is adjusted.

At the same time as performing calibration, the main control portion 80 acquires the output value V of the toner concentration sensor 31 (step S3). The main control portion 80 then checks whether or not the difference Vtarget−V between the target value Vtarget of the toner concentration sensor 31 as it should be observed when the toner concentration inside the developing device 3*a* to 3*d* equals the reference concentration and the output value V acquired at step S3 is equal to or larger than a threshold value X (step S4). If Vtarget−V>X ("Yes" at step S4), the main control portion 80 calculates a cumulative printing ratio W1 until calibration and stores it in the storage portion 70 (step S5). In this example of control, the cumulative printing ratio is the cumulative printing ratio as observed since the start of the use of the image forming apparatus 100.

Thereafter, the main control portion 80 shifts into a standby state in which it checks whether or not a print instruction has been received (step S6). If Vtarget−V<X ("No" at step S4), the main control portion 80, without storing the cumulative printing ratio W1, shifts into the standby state waiting for a print instruction (step S6). On receiving a print instruction ("Yes" at step S6), the main control portion 80 performs printing by ordinary image forming operation (step S7).

If no condition for performing calibration is met at step S1 ("No" at step S1), the main control portion 80, without performing calibration, shifts into the standby state (step S6).

Next, the main control portion 80 checks whether or not a cumulative printing ratio W1 is stored (step S8). If a cumulative printing ratio W1 is stored ("Yes" at step S8), the main control portion 80 calculates the current cumulative printing ratio W (step S9). The main control portion 80 then checks whether or not the difference W−W1 between the cumulative printing ratio W1 as it is until calibration and the current cumulative printing ratio W is equal to or larger than a threshold value Y (step S10). The threshold value Y is the printing ratio (amount of toner consumed) that corresponds to the difference Vtarget−V between the target value Vtarget and the output value V of the toner concentration sensor 31. That is, the threshold value Y is not a constant value but a value that varies with the difference Vtarget−V between the target value Vtarget and the output value V of the toner concentration sensor 31.

If W−W1<Y ("No" at step S10), a return is made to step S6, where the standby state in wait for a print instruction is continued. If W−W1≥Y ("Yes" at step S10), a return is made to step S2, where calibration is performed, and thereafter a similar procedure is repeated (steps S2 to S10).

On the other hand, if no cumulative printing ratio W1 is stored at step S8 ("No" at step S8), this means that the difference between the target value Vtarget and the output value V of the toner concentration sensor 31 during the previous calibration was small. Accordingly, a return is made to step S1, where whether or not a usual condition for performing calibration is met is checked, and thereafter a similar procedure is repeated (steps S1 to S10).

Through the control described above, during calibration, the toner concentration sensor 31 senses the toner concentration in the developer inside the developing devices 3*a* to 3*d*, and the sensing result is compared with a target value of the toner concentration so that, if there is a difference equal to or larger than a predetermined value, the cumulative printing ratio W1 until calibration is stored in the storage portion 70. Later, when its difference W−W1 from the cumulative printing ratio W having the printing operation thereafter added to it equals the printing ratio (amount of toner consumed) corresponding to the difference in toner concentration, calibration is performed again.

In this way, in a situation where the output value of the toner concentration sensor 31 is higher than the target value and printing after calibration is expected to suffer low image density, with appropriate timing when toner has been consumed until the toner concentration inside the developing devices 3*a* to 3*d* has fallen to the target value, calibration is performed again. It is thus possible to minimize the period in which the image forming apparatus 100 is used with a greatly varied toner concentration inside the developing devices 3*a* to 3*d*. There is no need to correct the output value of the toner concentration sensor 31 in accordance with temperature, and it is thus possible to reduce the number of temperature sensors.

When the difference between the output value 31 and the target value of the toner concentration sensor is small, calibration is performed when a usual condition for performing calibration is met. It is thus possible to restrain an increase in the amount of toner consumed by calibration performed with inappropriate timing and a drop in image formation efficiency (an increase in the waiting time for printing).

In the example of control shown in FIG. 4, as the cumulative printing ratios W1 and W, those as observed since the start of the use of the image forming apparatus 100 are calculated; instead, for example, the cumulative printing ratios W1 and W can be cumulative printing ratios since a given time point before calibration. Cumulative printing ratios only during printing operation after the previous calibration can be calculated separately. That is, calibration can be performed again when the cumulative printing ratio during printing operation after the previous calibration becomes equal to the printing ratio (amount of toner consumed) corresponding to the difference in toner concentration.

Whether or not to perform calibration again is determined based on the difference W1−W between the cumulative printing ratio W1 as observed during the previous calibration and the current cumulative printing ratio W. This, however, is not meant as limitation to cumulative printing ratios; instead, it is possible to use any value that represents the amount of toner consumed corresponding to the difference Vtarget−V between the target value Vtarget and the output value V of the toner concentration sensor 31. For example, it is possible to judge that the amount of toner consumed corresponding to Vtarget−V has been reached when the output value V of the toner concentration sensor 31 has risen up to the target value Vtarget.

It is also possible to determine whether or not to perform calibration again based on the cumulative number of sheets printed, or the cumulative driving time of the developing devices 3*a* to 3*d*, after the previous calibration. The threshold value for the cumulative number of sheets printed or the cumulative driving time is not a constant value but a value that varies with the difference Vtarget−V between the target value Vtarget and the output value V of the toner concentration sensor 31.

In the example of control shown in FIG. 4, the toner concentration in the developer inside the developing devices 3*a* to 3*d* is sensed by the toner concentration sensor 31 during calibration. Instead, the toner concentration in the developer inside the developing devices 3*a* to 3*d* can be sensed by the toner concentration sensor 31 during the first printing operation after calibration.

The present disclosure can be implemented in any manner other than as in the embodiment described above, and allows for any modifications without departing from the spirit of the present disclosure. For example, while the embodiment described above deals with an image forming apparatus 100 provided with a developing device 3*a* to 3*d* of a two-component developer type provided with a developing roller (developer carrying member) 30 that carries two-component developer, this is not meant to limit the present disclosure. The present disclosure is applicable to an image forming apparatus provided with a developing device where a developer carrying member such as a magnetic roller is additionally provided between the feeding-conveying screw 25*b* and the developing roller 30 so that developer is supplied from the feeding-conveying screw 25*b* to the magnetic roller and then only toner is supplied from the magnetic roller to the developing roller 30.

The present disclosure is applicable not only to color printers like the one shown in FIG. 1 but also to monochrome printers, digital multifunction peripherals, color copiers, facsimile machines, etc., that is, various image forming apparatuses provided with a developing device of a two-component developer type.

The present disclosure is applicable to image forming apparatuses provided with a developing device of a two-component developer type. According to the present disclosure, it is possible to provide an image forming apparatus that can restrain a drop in image density even when there is a difference between the output value of a toner concentration sensor and the toner concentration inside the developing device.

What is claimed is:

1. An image forming apparatus comprising:

an image forming portion including:

an image carrying member which has a photosensitive layer formed on a surface thereof;

a charging device which electrostatically charges the surface of the image carrying member;

an exposing device which exposes the surface of the image carrying member electrostatically charged by the charging device to light to form an electrostatic latent image; and a developing device having:

a developer container which stores two-component developer containing carrier and toner, a developer carrying member which is rotatably supported inside the developer container and which carries the two-component developer on a surface thereof; and a toner concentration sensor which senses toner concentration in the two-component developer inside the developer container;

the developing device developing the electrostatic latent image into a toner image by use of the developer carrying member, a developing voltage power supply which applies a developing voltage to the developer carrying member;

an image density sensor which senses image density of the toner image formed by the image forming portion; and a control portion which controls the image forming portion and the developing voltage power supply, wherein the control portion can perform calibration for correcting the image density by adjusting the developing voltage based on a sensing result from the image density sensor, and the control portion senses the toner concentration with the toner concentration sensor during the calibration or during first image formation after the calibration and, if a difference Vtarget−V between an output value V of the toner concentration sensor that is actually sensed and a target value Vtarget of the toner concentration sensor that should be observed when the toner concentration equals a reference concentration is equal to or larger than a predetermined value, the control portion performs the calibration again when an amount of toner consumed reaches a predetermined threshold value after the calibration.

2. The image forming apparatus according to claim 1, wherein the control portion takes, as the threshold value based on which the control portion performs the calibration again, an amount of toner consumed that corresponds to Vtarget−V.

3. The image forming apparatus according to claim 2, wherein when Vtarget−V is equal to or larger than a predetermined value, the control portion judges whether or not the amount of toner consumed that corresponds to Vtarget−V has been reached based on a cumulative printing ratio after the calibration.

4. The image forming apparatus according to claim 3, further comprising:

a storage portion which stores the cumulative printing ratio, wherein when Vtarget−V is equal to or larger than the predetermined value, the control portion calculates and stores in the storage portion a cumulative printing ratio W1 until the calibration and, when the cumulative printing ratio W1 is stored, the control portion performs the calibration again when a difference W−W1 between the cumulative printing ratio W1 and the cumulative printing ratio W having image forming operation after the calibration added thereto is equal to or larger than a threshold value.

5. The image forming apparatus according to claim 2, wherein when Vtarget−V is equal to or larger than the predetermined value, the control portion judges whether or not the amount of toner consumed that corresponds to Vtarget−V has been reached based on the output value V of the toner concentration sensor after the calibration.

6. The image forming apparatus according to claim 2, wherein when Vtarget−V is equal to or larger than the predetermined value, the control portion judges whether or not the amount of toner consumed that corresponds to Vtarget−V has been reached based on a cumulative number of sheets printed after the calibration.

7. The image forming apparatus according to claim 2, wherein when Vtarget−V is equal to or larger than the predetermined value, the control portion judges whether or not the amount of toner consumed that corresponds to Vtarget−V has been reached based on a cumulative driving time of the developing device expended in image formation after the calibration.

8. The image forming apparatus according to claim 1, wherein the control portion performs the calibration when at least one of the following conditions is met: when power to the image forming apparatus is turned on; when a return is made from a power-saving mode; and when a cumulative number of sheets printed after the calibration has reached a predetermined number of sheets.

9. The image forming apparatus according to claim 1, wherein the toner concentration sensor is a magnetic permeability sensor which senses magnetic permeability of the two-component developer.

* * * * *